United States Patent [19]

Portmann et al.

[11] 3,943,696

[45] Mar. 16, 1976

[54] CONTROL DEVICE FOR SETTING A TIMEPIECE

[75] Inventors: Hubert Portmann; Eric Saurer, both of Hauterive; Pierre Hersberger, Neuchatel, all of Switzerland

[73] Assignee: Ebauches S.A., Neuchatel, Switzerland

[22] Filed: July 2, 1974

[21] Appl. No.: 485,107

[30] Foreign Application Priority Data

July 13, 1973 Switzerland ..... 10216/73

[52] U.S. Cl. ..... 58/23 R; 58/85.5

[51] Int. Cl.[2] ..... G04B 27/08

[58] Field of Search ..... 58/23 R, 50 R, 85.5

[56] References Cited

UNITED STATES PATENTS

| | | | |
|---|---|---|---|
| 3,643,418 | 2/1972 | Polin et al. | 58/23 R |
| 3,699,763 | 10/1972 | Zeph | 58/23 R |
| 3,756,011 | 9/1973 | Nishimura et al. | 58/85.5 X |
| 3,810,356 | 5/1974 | Fujita | 58/85.5 X |

*Primary Examiner*—L. T. Hix
*Assistant Examiner*—U. Weldon
*Attorney, Agent, or Firm*—Imirie, Smiley & Linn

[57] ABSTRACT

An electronic timepiece including a time-keeping circuit having serially connected counters generating day, hour, minute and second signals; a four digit display connected to the counters; a selecting circuit coupled to the counters and having one mode for the display of two units of real time, and a plurality of other modes for the selection and display of each single unit of time for correction; a first switch connected to the selecting circuit and actuable to sequentially advance the selecting circuit from one mode to another; and a second switch coupled to the selecting circuit and the counters for causing the display of a different two units of real time when the selecting circuit is in the first mode, and for correcting each individually selected unit of time when the selecting circuit is in one of its other modes.

6 Claims, 4 Drawing Figures

CONTROL DEVICE FOR SETTING A TIMEPIECE

The invention find applications in the watch industry.

BACKGROUND OF THE INVENTION

The present invention relates to electronic timepieces and more particularly to a control device for setting a timepiece having a digital display.

In order to set an electronic timepiece it is necessary, in principle, to correct each counter, i.e. minute, hour and day counters, because it is difficult to accurately set the timepiece with a variable speed clock pulse generator (quick for rough adjustment, then progressively slower as the correct time is approached) and because the electronic circuits are not necessarily adapted to an excessively high input frequency. If, for instance, the hours display is to be set at the rate of two units/second, it will be necessary to supply the seconds counter with pulses having a frequency over 7000 Hz. In addition, the adjustment of time between various time-zones and date (at the end of a 30-day month) should be done without disturbing the normal working of the watch.

A simple well-known solution is to provide the watch with buttons each corresponding to a specific function, for instance:

a button for enabling the adjustment of the date display at a rate of one unit/second, while the remaining parts of the watch continue to work normally;

another button to correct the hours display at a rate of one unit/second, with the passing of the 24 hours point having preferably no influence on the advance of the date, minutes and seconds displays which run normally;

a third button for correction of the minutes display with preferably no advance of the hours display at the 60 minutes point, the seconds and hours displays running normally;

finally a fourth button to stop the seconds counter and reset the same to zero. This method enables setting of the timepiece in any way and it is easy to identify the function to be performed, either by marking the buttons or by their positions geometrically associated with respect to the display.

The present invention tends to solve the problem of setting a watch the display of which normally shows only hours and minutes, but which can also show date and second on the same display, if wanted. This problem could be controlled with the four buttons mentioned above and an additional one for date and seconds. This solution, however, has a disadvantage: handling of two buttons is necessary to fix the date, which handling is not very convenient.

In another prior art arrangement the number of buttons is reduced to two, i.e. a rotating switch whose different positions correspond to well-defined functions and a push button to perform the selected function.

SUMMARY OF THE INVENTION

The present invention tends to eliminate the disadvantages of mechanical commutators, such as difficulties of manufacture and fragility, by means of a selector made up of a sequential electronic circuit with at least one control input but with several outputs each corresponding to one of the functions to be performed and by means designed to identify the state of this sequential circuit on the display.

DETAILED DESCRIPTION OF THE INVENTION

Figure 1:
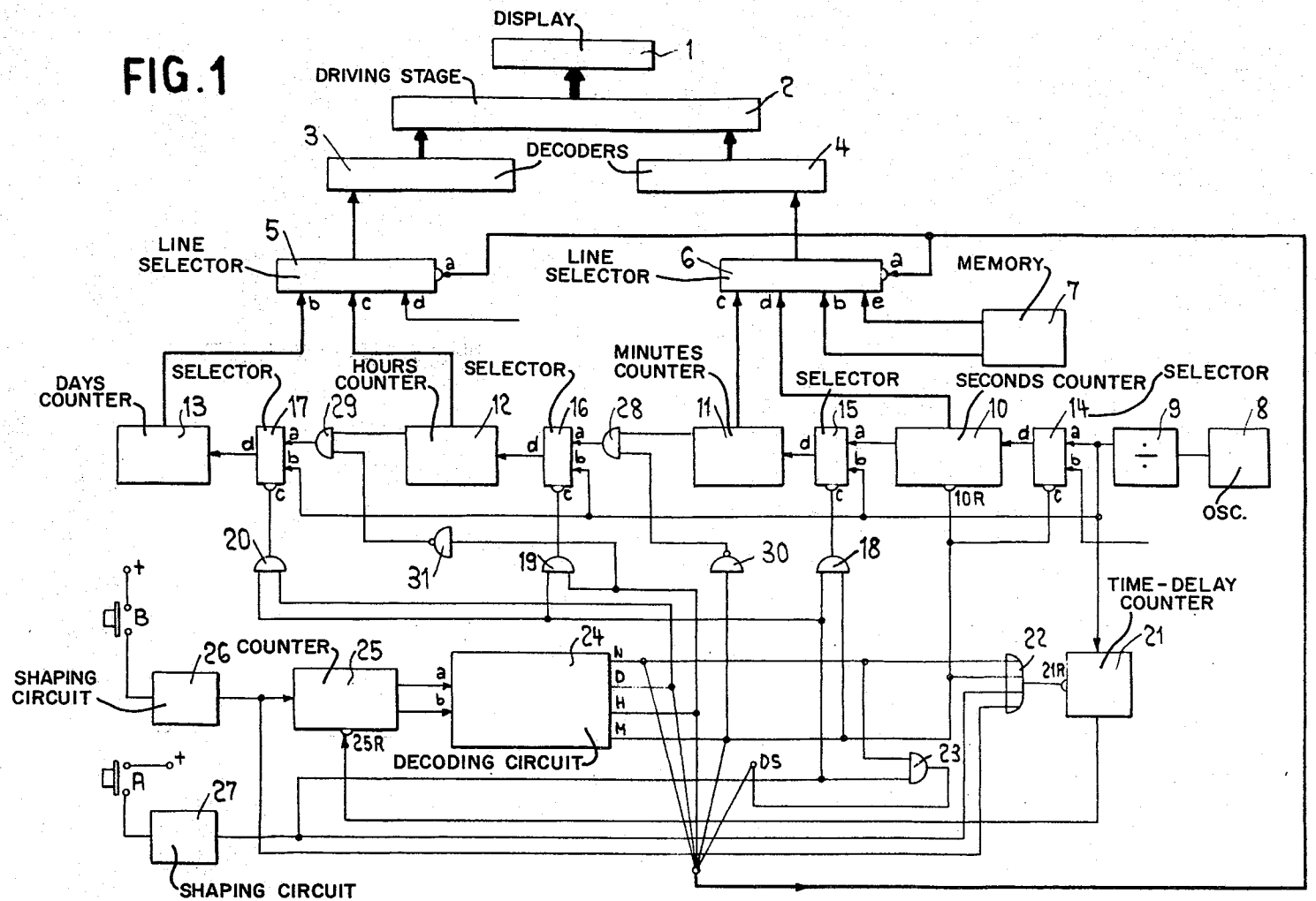
FIG. 1 is a block diagram of a timepiece selling network according to the present invention.

FIG. 1 shows a complete block diagram of a watch with electronic display provided with a system of setting time according to the invention. The display 1, consisting of four digits designated to show two numbers of two figures each, is controlled by a driving stage 2; The four digits of the display having each seven segments, twenty eight controlling lines will be necessary (thick line); the driving stage 2 of the display has two inputs of fourteen lines each (thick line), supplied by two decoders 3 and 4. The decoder 3 drives the first two digits which will indicate either the date or the hours, and the decoder 4 drives the two other digits which will indicate either the minutes or the seconds. The two decoders receive information in binary coded decimal (BCD) form over two channels consisting of eight lines from two line selectors 5 and 6. The selectors 5 and 6 each have control inputs *a* consisting each of 5 lines coming from a decoding circuit 24 described below. The selector 5 has three signal inputs; *b*, *c* and *d*, while the selector 6 has four signal inputs *b*, *c*, *d*, and *e* from which the output selection is made. Depending on the state of the 5-bit control input, the selectors 5 and 6 will pass one of the inputs *b*, *c*, *d* (or *e*) to the output. The watch also has a counting chain consisting of an oscillator 8, divider 9 distributing impulses with a frequency of 1 Hz, counters 10, 11, 12 and 13 respectively for seconds, minutes, hours and dates; and selectors 14, 15, 16 and 17 which precede counters 10, 11, 12 and 13. These selectors have two inputs *a* and *b* on which the selection is done by means of a control input *c*. Selectors 14 to 17 are similar to selectors 5 and 6, but with one-bit control inputs, the state of which determines if the outputs will be supplied with signals of input *a* or *b*. All of the selectors may be formed of conventional logic gates or of commercially available integrated circuits. Inputs *a* are connected to a preceding counter either directly as with selectors 14 and 15, or by and gates 28 and 29 for selectors 16 and 17. The inputs *b* of selectors 15, 16 and 17 are directly connected to the output of the divider 9, while the input *b* of the selector 14 is a blank input for interrupting the flow of impulses from the divider 9 to the seconds counter 10.

Hours and days counters 12 and 13 each have an eight line BCD output connected respectively to the inputs *c* and *b* of the selector 5. The input *d* of selector 5 is a blank input which, when fed to decoder 3, causes nothing to be displayed. Similarly, seconds and minutes displays 10 and 11 have their outputs coupled respectively to inputs *d* and *c* of the selector 6; and inputs *b* and *e* are connected to the outputs of a dead memory or identifying signal generator 7 causing the display of letters *h* and *d*, respectively to identify "hours" or "days" units.

Concerning the control device itself, there are two switches A and B for supplying a positive voltage signal to two shaping circuits 26 and 27, respectively. The circuit 26 transmits this signal to the counter 25, the two output bits of which are transmitted to a decoding circuit 24 with four output lines: N, D, H and M (for: Normal, Date, Hour and Minute). The output N is connected both to the AND gate 23 and to the OR gate 22, the output D is directed to the AND gate 20, the output H to the AND gate 19 and, through an inverter 31 to the gate 29; finally the output M is directed to the gate 28 through the inverter 30, to the gates 18 and 22, to a reset-input 10R of the seconds counter 10 and to the control input c of the selector 14. The output of the shaping circuit 27 goes to the AND gates: 18, 19, 20 and 23 and to the OR gate 22. Also a time-delay counter 21 is connected to receive the output of the divider 9 whose reset-input 21 R is connected to the output of the OR gate 22. The output of the time-delay counter 21 is connected to the reset-input 25 R of the counter 25.

In order to clearly explain the working mode of the device, according to the invention, we reproduce below, in form of a table the responses of the decoding circuit 24 to the inputs *a* and *b*:

| INPUTS | | OUTPUTS | | | |
|---|---|---|---|---|---|
| a | b | N | D | H | M |
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

Figure 2:
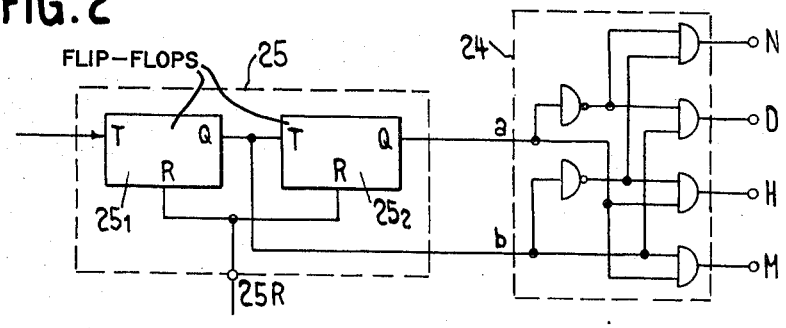
FIG. 2 is a block diagram of the sequencing circuit of FIG. 1.

FIG. 2 shows in more detail the counter 25 consisting of two T flip-flop circuits $25_1$, $25_2$ in series whose Q outputs are connected to the inputs *a* and *b* of the decoding circuit 24, also presented in detail. The working mode of circuit 24 is sufficiently clearly exibited in the above table that further description is not made for the sake of brevity.

While working normally, the two switches A and B are open, the outputs of the counter 25 are zero and the output N of the decoding circuit 24 is at the potential 1, as well the input 21 R of the counter 21 by means of the OR gate 22. The counter 21 is thus inhibited. The other outputs, D, H and M being on zero, the inputs *c* of selectors 15, 16 and 17 will also be on zero, such that the inputs *a* will then be connected to outputs *d*. Through inverters 30 and 31, the gates 28 and 29 will let pass impulses they receive from preceding counters. Control inputs a of selectors 5 and 6 are supplied by five lines N, D, H, M and DS whose state, in normal running is: 1, 0, 0, 0, 0, respectively. In that case, the output of selector 5 receives the input *c* (from counter 12) and the output of selector 6 receives its input *c* (from minutes counter 11). The timepiece then shows hours and minutes. With the switch A on, a potential 1 appears at the output DS of the gate 23; the state of control lines N, D, H, M and DS will then be: 1, 0, 0, 0, 1. The output of selector 5 will receive the input *b* (from days counter 13) and the output of selector 6 will receive its input *d* (from seconds counter 10). Without affecting the remainder of the circuit, the watch will then show the date and the second with the switch A on. If switch A is off and the switch B is on for a short while, the counter 25 receives an impulse and its output *a, b* will be in the state 0, 1. The output D will be at the potential 1 as well as one of the inputs of the gate 20. The output N comes to zero. We thus have, for the five control lines the state: 0, 1, 0, 0, 0; the output of selector 5 will be connected with the input b (days counter) and the output of the selector 6 will be connected with the input *b*, making the letter "d" appear for the date. At this stage all the inputs of the gate OR gate are then at zero; its output therefore does not inhibit the time-delay counter 21 which counts and after an interval of for instance four or eight seconds, releases a pulse which, through the input 25 R, will reset the counter 25 to zero.

On the contrary, if the switch A is put on before four or eight seconds are over, a potential 1 is brought to the gate 22 putting the counter 21 on zero. Also, since the output of the gate 20 is at the potential 1, selector 17 will supply output *d* with signals from input *b* and the date counter will be supplied with pulses at 1 Hz to advance the accumulated count in the date counter and the corresponding date being displayed. When the switch A is again actuated, the selector 17 is caused to revert to its original state connecting input *a* to output *d* so that the counter works normally again; since the time-delay counter 21 is no longer inhibited, it will put the counter 25 on zero after an certain lapse of time. Again, if the switch B is put on before this lapse of time is over, the control line from the output of decoding circuit 24 will assume to the state: 0, 0, 1, 0, 0; the output of selector 5 will be connected with the input *c* and the output of selector 6 with the input *e*, to make the letter *h* appear from memory 7. The AND gate 29 is then blocked and no signal will reach the days counter 13. The selector 16 is then switched to pass input *b*, making the counter 12 advance at the rate of one unit per second. By repeating the above described operation minutes counter 11 can next be corrected in this state, however, the seconds counter is reset to zero, and the selector 14 passes input *b* which is a blank line so that the counting is interrupted. The selector 5 passes input *d* which is also a blank line, and the selector 6 passes input *c* to make the minutes count appear. Actuating switch B again reestablishes the normal counting and display of the circuit.

Figure 3:
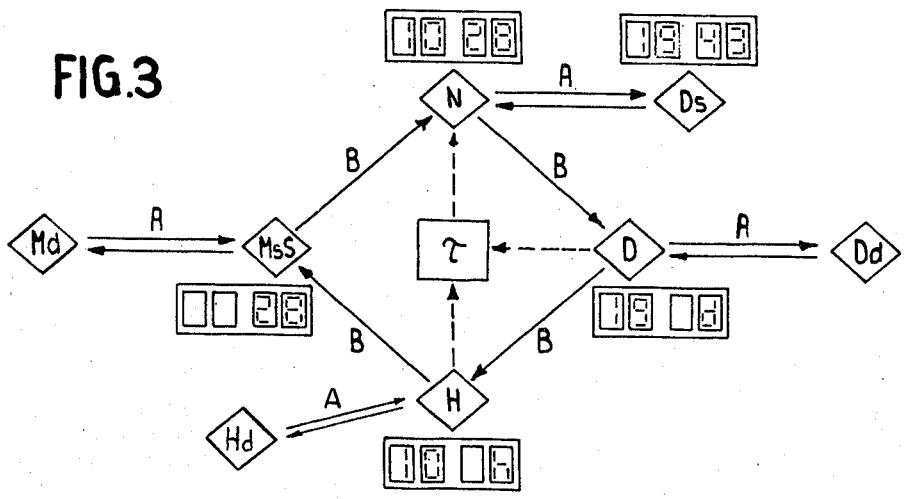
FIG. 3 is a diagrammatic illustration of the operation of the network of FIG. 1.

The diagram of FIG. 3 outlines the different operations. The diamond-shaped blocks with letters N, D, H and MsS indicate the different states or modes obtained by successively actuating switch B (N: Normal, D: Days, H: Hours and M.sS: Minutes stop seconds). Diamonds with letters Ds, Dd, Hd, Md represent the effects obtained by actuating switch A. Adjacent blocks N, Ds, D, H and MsS the content of the timepiece display has been indicated. Working normally, in the position N, the watch shows the hour and the minute, in the example: 10 hours 28 minutes. In this mode, switching the button A causes the date and the second to appear, i.e.: the 19th of the month and the 43rd second (running normally). Actuation of button B sequences the circuit to the position D where the display shows the date (the 19th) on the left side, and the symbol *d* on the right. By pushing the button A in this mode, the displayed dates pass at a rate of a unit per second, Dd meaning "Dates are running." Once the button A is released, the circuit reverts back to the date display mode D. Actuation of switch B again sequences the circuit to mode H where the hours are displayed on the left and the symbol *h* on the right. The switch A, in this mode, causes the displayed hours to pass at a rate of a unit/second; releasing A again allowing the circuit to revert back to the position H. Actuating switch B a third time sequences the circuit to mode MsS, where only minutes will appear on the right. In this position, the counting is interrupted and the watch stops. Actuation of switch A then causes the minutes display to advance at the rate of one unit per second. Once the counters of days, hours and minutes are set, switch B is again actuated to return the whole circuit to its initial state or normal running mode N. In addition, mode N is automatically attained from any other mode if, after a selected lapse of time (4 or 8 seconds), no operation has been done.

It is clear that the automatic return to the normal position N is not indispensable, for example it can be replaced by a button to avoid having to pass through all the positions of the cycle.

Figure 4:
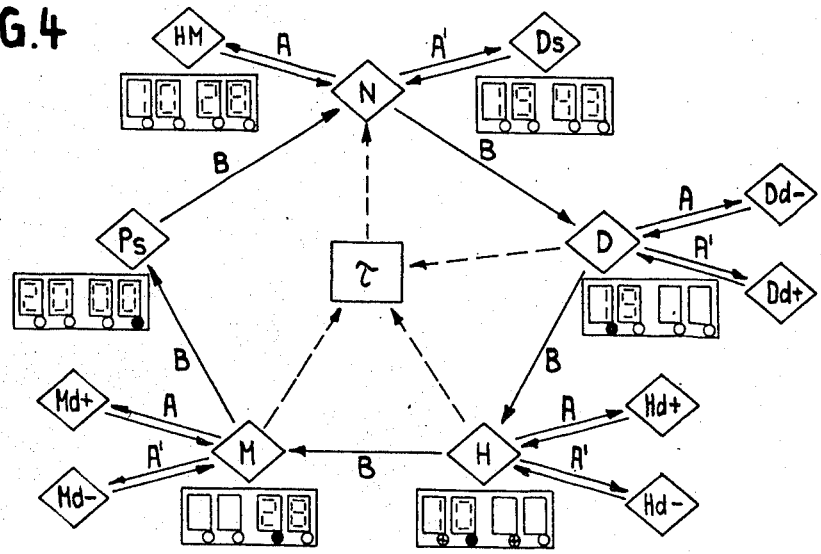
FIG. 4 is a diagrammatic illustration a second example of construction according to the invention.

FIG. 4 diagrammatically shows a second example of construction. The cycle comprises an additional station; the previous position MsS being divided into two: M on the one hand, a position enabling correction of the minutes counter without interruption of the counting of seconds, and Ps (possibility to stop), on the other hand, a position in which the watch can be stopped by pushing the button A. In addition, the button A from the previous figure is replaced by two buttons A and A′ which, from the position D, H and M will perform two operations A and A′. The operation A results in advancing a selected counter (D, H or M), the operation A′ results in moving it back. To move back by one day, for instance, it is better go back one unit than to advance 30.

In the position Ps, both possibilities A and A′ will result in the stop of the watch and the return to zero of the counter of seconds. In the position N, by pushing A, we shall have the display of hours and minutes HM appear, by pushing A′ we shall have the display of dates and seconds Ds. The marking of the sequential circuit in this example, is done by means of dots separating each digit: in the position N no dot stands out brightly; in the position D the first dot is shining, in the position H, the second, in the position M, the third and in the position Ps the fourth. Some timepieces show hours up to 12 (two half-days: morning and afternoon). In this case, while setting the counter of hours we must know if it is a.m. or p.m. To do so we shall illuminate the dot at the left of the already shining one, if it is a.m., and the one on the right if it is p.m.

In order to avoid the manipulation of the button B each time we want to advance the sequential circuit 24, 25 (FIG. 2), we can connect one of the terminals of the switch B to the output of the divider 9, the other terminal remaining connected to the input of the counter 25. The sequential circuit will then advance by one step per second for as long as the switch B is on.

What is claimed is:

1. An electronic timepiece comprising a time-keeping circuit having serially connected counters for generating day, hour, minute, and second signals; a four-digit display connected to said counters; selecting means coupled to said counters and having one mode for the display of two units of real time, and a plurality of other modes for the selection and display of each single unit of time for correction; first switch means connected to said selecting means and actuable to sequentially advance said selecting means from one mode to another; and second switch means coupled to said selecting means for causing the display of a different two units of real time when said selecting means is in said one mode, and for correcting said selected single unit of time when said selecting means is in one of said other modes.

2. An electronic timepiece according to claim 1 wherein said selecting means includes time-delay counter means for automatically resetting said selecting means to said one mode a preselected time after actuation of said first and second switches.

3. An electronic timepiece according to claim 1 wherein said selecting means comprises means for interrupting the serial interconnection of adjacent counters when said selecting means is in a mode for the correction of a unit of time.

4. An electronic timepiece according to claim 1 wherein said selecting means comprises means for generating at least one signal identifying a particular unit of time, said selecting means causing the display of said identifying signal when in a mode for the correction of said particular unit of time.

5. An electronic timepiece according to claim 1 wherein said selecting means is connected to cause the display in said one mode of hour and minute signals when said second switch means is unactuated, and day and second signals when said second switch means is actuated.

6. An electronic timepiece according to claim 1, wherein said selecting means comprises a 2-bit counter coupled to a decoder for establishing the operative mode of said selecting means, said 2-bit counter connected to advance by one count for each actuation of said first switch means.

* * * * *